US005873195A

United States Patent [19]

Wortham

[11] Patent Number: 5,873,195

[45] Date of Patent: Feb. 23, 1999

[54] SUPPORT STRUCTURE FOR SUPPORTING PLANTS AND OTHER OBJECTS

[76] Inventor: Larry E. Wortham, 300 England Ave., Fuquay-Varina, N.C. 27526

[21] Appl. No.: 851,429

[22] Filed: May 5, 1997

[51] Int. Cl.[6] ..... A47G 7/00; A47B 43/00

[52] U.S. Cl. ..... 47/39; 211/207

[58] Field of Search ..... 47/39; 211/207, 211/205, 118; 248/188.1, 165, 167

[56] References Cited

U.S. PATENT DOCUMENTS

| | | | |
|---|---|---|---|
| D. 185,137 | 5/1959 | DeMelle | 47/39 |
| 309,349 | 12/1884 | Hart | 47/39 |
| 342,476 | 5/1886 | Swartwout | 47/39 |
| 577,230 | 2/1897 | Boyd | 47/39 |
| 1,729,004 | 9/1929 | Miadowicz | 248/188.1 |
| 1,747,951 | 2/1930 | Reichert | 248/165 |
| 1,895,794 | 1/1933 | Hayden | 248/165 |
| 2,003,986 | 6/1935 | Witthuhn | 47/39 |
| 2,092,691 | 9/1937 | Berghoff | 248/188.1 |
| 2,094,486 | 9/1937 | Cohen | 248/165 |
| 2,187,159 | 1/1940 | Koch | 248/188.1 |
| 2,794,554 | 6/1957 | Donner | 47/39 |
| 3,015,024 | 12/1961 | Charchan et al. | 47/39 |
| 3,638,814 | 2/1972 | Lowery | 211/177 |
| 3,708,144 | 1/1973 | Nasmith | 248/167 |
| 3,734,301 | 5/1973 | Rastocny | 211/177 |
| 4,032,098 | 6/1977 | Marschak | 248/165 |
| 4,125,965 | 11/1978 | Schweim | 47/39 |
| 4,194,319 | 3/1980 | Crawford | 47/27 |
| 4,351,441 | 9/1982 | Schramm | 211/207 |
| 4,770,303 | 9/1988 | Boyd | 211/205 |
| 4,801,123 | 1/1989 | Lynch | 248/524 |
| 4,942,693 | 7/1990 | Sibold | 47/44 |
| 4,991,344 | 2/1991 | Carney | 47/39 |
| 5,015,510 | 5/1991 | Smith | 428/18 |
| 5,022,620 | 6/1991 | Scott | 248/188.6 |
| 5,037,049 | 8/1991 | Funk | 248/165 |
| 5,178,286 | 1/1993 | Allison, III | 211/71 |
| 5,234,115 | 8/1993 | Lin | 211/196 |
| 5,487,476 | 1/1996 | Barfield | 211/71 |

FOREIGN PATENT DOCUMENTS

| | | | |
|---|---|---|---|
| 1327100 | 4/1963 | France | 47/39 P |
| 578350 | 6/1933 | Germany | 47/39 |
| 680145 | 8/1939 | Germany | 47/39 |
| 47788 | 5/1966 | Germany | 47/39 |
| 445043 | 2/1968 | Switzerland | 47/39 C |
| 968489 | 9/1964 | United Kingdom | 47/39 |

OTHER PUBLICATIONS

"Perkins", Fairfax Northern Virginia Sun, p. 12, Mar. 31, 1979.

"Beagle Manufacturing Co. Advertisement", American Nurseryman, p. 109, vol. 144, No. 6. Sep. 15, 1976.

"Wrought Iron", Popular Science, Apr. 1939, pp. 194 and 195, Apr. 1934.

*Primary Examiner*—Michael J. Carone
*Assistant Examiner*—Fredrick T. French, III
*Attorney, Agent, or Firm*—Rhodes, Coats, & Bennett, LLP

[57] ABSTRACT

The present invention entails an elongated upright post that includes a series of supports secured on and around the elongated post and which are movable up and down adjacent the post. Each of the supports includes an elongated section that runs adjacent the post and an outwardly projecting section that extends outwardly with respect to the post for supporting a flower or plant-type hanging basket or other object. A series of set screws are attached adjacent the supports. The set screws are operative to engage a support and to effectively retain the support in a fixed vertical position. However, the set screws can be released from the supports and the supports can be moved up and down so as to adjust their vertical height.

18 Claims, 3 Drawing Sheets

SUPPORT STRUCTURE FOR SUPPORTING PLANTS AND OTHER OBJECTS

FIELD OF THE INVENTION

The present invention relates to support structures for hanging plant baskets and other objects and more particularly to a support structure having a series of vertically adjustable supports that are circumferentially spaced around a central post.

BACKGROUND OF THE INVENTION

Hanging baskets that hold plants and flowers are commonly used by homeowners and gardeners on porches, patios, gazebos and other areas around a home or building. However, the use of such hanging baskets is fairly limited because they do require some form of overhead structure for supporting the hanging baskets. Typically, in the case of a porch, for example, a screw hook can be secured within an overhead structure or the ceiling. In such cases, the hanging basket typically includes a series of wires that extend upwardly from the basket and are secured around the downwardly extending hook.

There have been attempts in the past at designing an upright stand or structure for supporting plants. For example, see the disclosures found in the following U.S. Pat. Nos. 47,664; 37,070; 5,037,049; 4,991,344; and 2,794,554. These patents generally show a support structure that comprises a post, a base for supporting the central post, and a plurality of outwardly directed supports or hangers. There are numerous drawbacks and disadvantages to these plant support structures. Many plant support structures of the prior art have utilized fixed hangers or supports, that is supports that are not vertically adjustable. Thus, in such designs, the supported plants or hanging baskets are always supported in the same fixed vertical position. Obviously, one cannot adjust the hangers or supports to particularly accommodate certain size plants or give one the capability of positioning the plants at various elevations with respect to each other to yield different overall appearances.

In addition, plant stands of the prior art have often been unduly complicated, included many parts, and generally been unstable and unsafe. In the end, they have been expensive and sometimes impractical to manufacture.

Therefore, there has been and continues to be a need for a sturdy plant stand that is practical and relatively easy to manufacture. In addition, it is desirable that the plant stand include a plurality of vertically adjustable supports that can be moved up and down relatively easy and stationed at various heights.

SUMMARY AND OBJECTS OF THE INVENTION

The present invention presents a support structure for supporting plants and other objects that overcomes the drawbacks and disadvantages of plant stands of the prior art.

The support structure of the present invention includes an elongated central post that is adapted to be support in a vertical upright position. A series of vertically adjustable supports are secured about the central post and are operative to be moved up and down and stationed at various elevations or heights about the post. Each of the vertically adjustable supports includes an elongated section that extends along and adjacent the post and an outwardly projecting section that projects outwardly from the post for supporting a hanging basket or other object. The post is provided with a holding or confining structure that is operative to engage and support the elongated sections of the supports. The holding structure is disposed around the post in such a fashion that the adjustable supports are held in a circumferentially spaced pattern around the post. The holding structure includes a series of releasable fasteners that are operative to engage and hold the respective supports in a selected vertical position. These releasable fasteners can be released, enabling the supports to be moved up and down and adjusted to a selected vertical height after which the releasable fasteners can be re-engaged with the supports so as to securely station the supports in a fixed position about the post.

It is therefore an object of the present invention to provide a plant support structure for supporting plants and hanging baskets and other objects that includes a series of vertically adjustable hangers or supports that can be easily raised and lowered and stationed at various elevations.

Another object of the present invention is to provide a support structure of the character referred to above that is of a relatively simple design which can be economically and practically manufactured.

Still a further object of the present invention resides in the provision of a support structure of the character referred to above that is strong and stable when the support structure assumes an erected position.

Another object of the present invention resides in the provision of a support structure having a series of supports or hangers secured to a central post wherein the supports or hangers can be easily adjusted vertically about the post.

Other objects and advantages of the present invention will become apparent and obvious from a study of the following description and the accompanying drawings which are merely illustrative of such invention.

BRIEF DESCRIPTION OF THE INVENTION

DETAILED DESCRIPTION OF THE INVENTION

Figure 1:
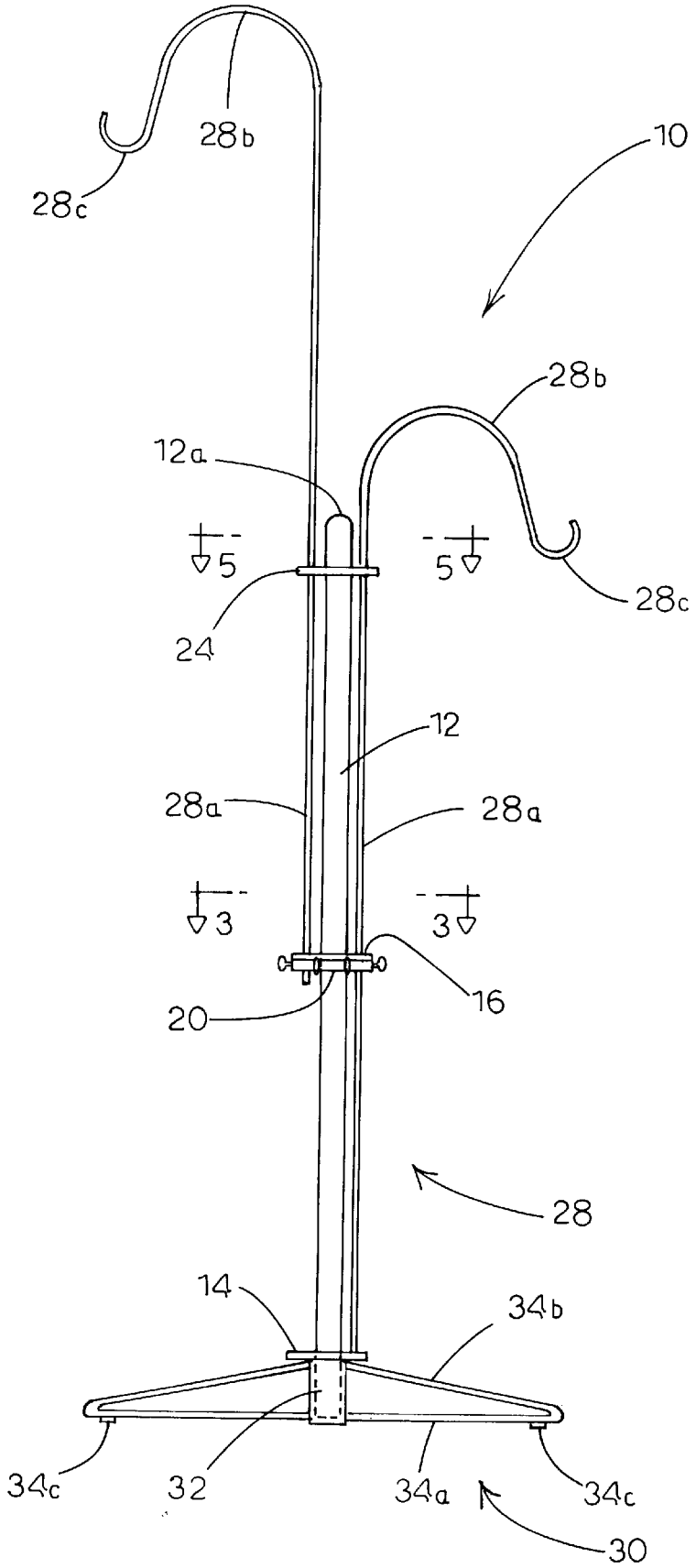
FIG. 1 is a side elevational view of the support structure of the present invention showing two supports secured at different elevations.

With further reference to the drawings, particularly FIG. 1, the support structure of the present invention is shown therein and indicated generally by the numeral 10. As will be appreciated from subsequent portions of this disclosure, support structure 10 is particularly adapted to support hanging plant baskets but it will be appreciated that the same could be utilized to support other hanging objects or to support objects from below.

Turning to a discussion of the support structure 10, the same includes an elongated central post 12. Post 12 includes upper and lower end portions. Formed about the upper end portion of the post 12 is a closed or rounded cap 12*a*. Post 12 can be constructed of various materials, but in a preferred embodiment the central post 12 would be constructed of metal.

The support post 12 is designed to support and hold a series of vertically adjustable supports 28. Details of the supports 28 and how they are arranged around the post 12 will be discussed herein later.

Returning to the central post 12, it is seen that the same includes a lower stop 14 secured to the lower end portion of the post 12. The stop 14 basically comprises an annular plate that is secured by weldment or other means to the post 12.

Figure 3:
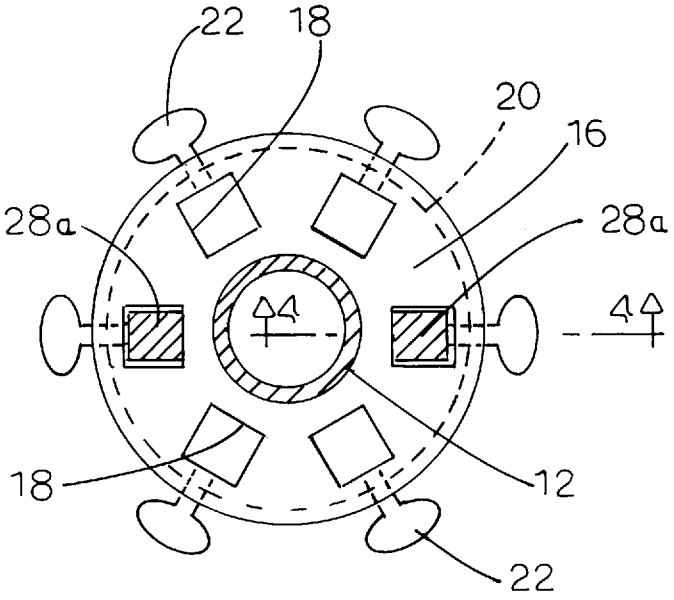
FIG. 3 is a cross-sectional view taken through the line 3—3 of FIG. 1.
Figure 2:
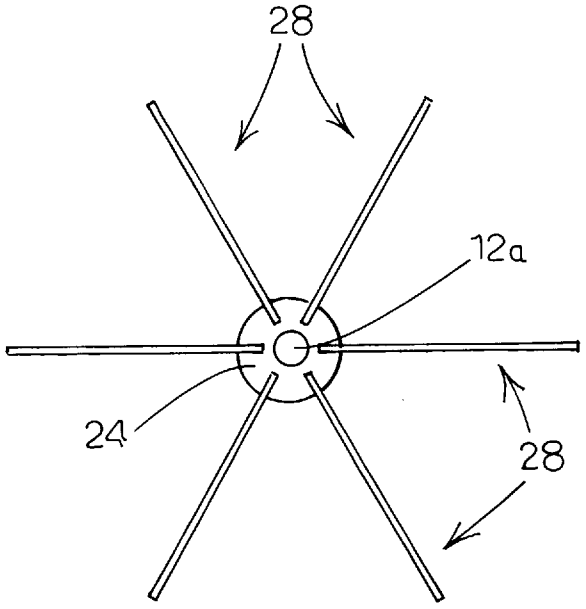
FIG. 2 is a top plane view of the support structure of the present invention illustrating six individual supports being secured within the support structure.
Figure 5:
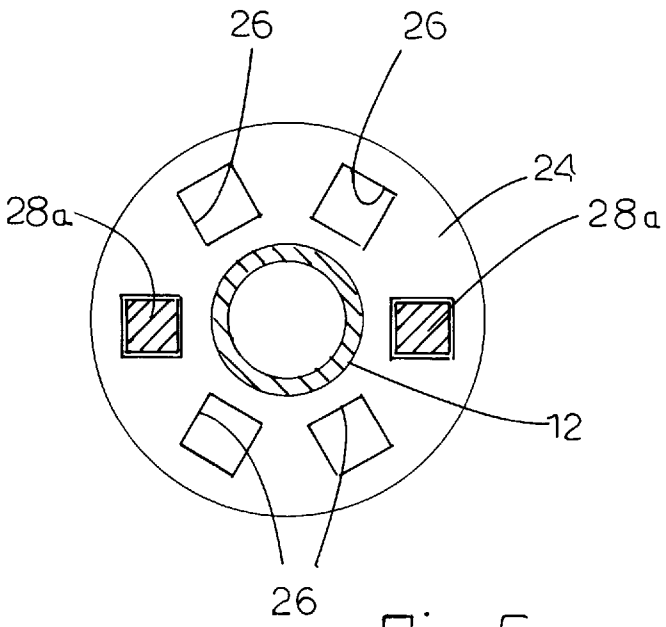
FIG. 5 is a sectional view taken through the line 5—5 of FIG. 1.
Figure 4:
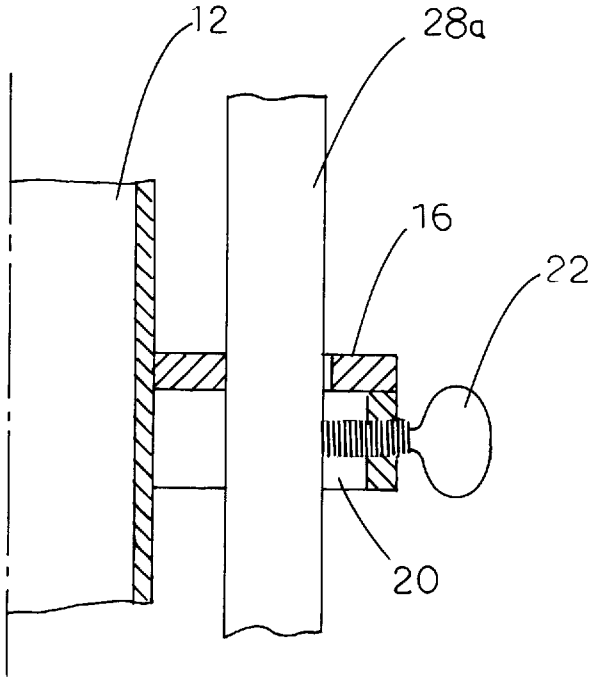
FIG. 4 is a fragmentary side sectional view illustrating a portion of the holding structure that forms a part of the support structure of the present invention.

Disposed above the stop 14 is a holding structure that is designed to hold and support the respective supports 28 and to permit the respective supports 28 to be vertically adjusted along the post 12. Forming a part of this holding structure is an intermediate guide that is disposed intermediately between the upper and lower end portions of the post 12. The intermediate guide includes an annular band 16 that is secured around the post 12 (FIGS. 3 and 4). It is appreciated that the annular band 16 lies in a plane that is generally transverse to the axis of the post 12. Formed in the annular band 16 is a series of circumferentially spaced openings 16. As will be appreciated from the drawings and from this disclosure, the respective supports 28 are designed to extend through these openings 18. Secured to the annular band 16 is an annular ring 20. Note that the annular ring 20 is secured generally normal to the annular band 16. That is, the annular ring 20 is generally concentric with the axis and outer wall of the central post. Formed in the annular ring 20 is a series of spaced apart threaded openings. These threaded openings receive a series of set screws or thumb screws 22. These set or thumb screws 22 act to engage the supports 28 and hold the supports in an upright and fixed position about the post. It will be appreciated that the set or thumb screws 22 form releasable fasteners in that they engage and hold the supports 28 about the post 12 but yet can be disengaged from the same supports to allow the supports 28 to be vertically adjusted about the post. Later in this disclosure, a more detailed discussion of how the set screws 22 function to hold and support the respective supports 28 will be discussed.

Also forming a part of the holding structure is an upper guide that is secured to the upper end portion of the post 12. The upper guide comprises a second annular band 24 that also includes a series of circumferentially spaced openings 26 formed therein. The openings 18 formed in the first annular band 16 are herein referred to as a first set of openings. Openings 26 formed in the second annular band 24 are referred to as a second set of openings. In any event, the first and second set of openings are vertically aligned such that respective aligned openings can be utilized to receive and confine a particular support 28. As shown in the drawings, it is seen that the openings 18 and 26 are generally square or rectangular in configuration. This is to accommodate the shape of the supports 28 which are also of a generally square or rectangular cross-section. Thus, once the supports 28 are confined within the openings 18 and 26, it is appreciated that the shape of the openings along with the shape of the supports prevents the supports from rotating.

Referring back to the supports 28, it is seen that each support includes an elongated section 28*a*. The elongated section 28*a* of each support extends generally along and adjacent a portion of the post 12. Formed about the upper portion of each support 28 is an outwardly extending section 28*b*. This section is referred to as an outwardly extending section because it extends outwardly from the post 12. In the embodiment illustrated herein, the upper portion or the outwardly extending section 28*b* is formed in a generally curved or inverted U-shape. It is appreciated however, that the outwardly extending section 28*b* could assume various other shapes. Additionally, formed about the terminal end portion of the outwardly extending section 28*b* is a hook 28*c*. The hook portion 28*c* functions to receive and hold a portion of the object being suspended by the support. in the case of a hanging basket, the upwardly extending wire that extends from the basket will be placed over the hook portion 28*c* of the support so as to hold and suspend the entire handing basket.

In one contemplated embodiment, the post 12 is stationed upright by pouring a concrete footing and placing the lower end portion of the post 12 in the concrete footing or in a sleeve provided within the concrete footing. This clearly forms a very strong and stable base for the post 12 and the overall support structure 10. Alternatively, the present invention entails a base, indicated generally by the numeral 30, that can be attached to the lower end portion of the post 12 to support the same. With reference to the drawings, the base 30 includes a central sleeve 32 that is of a particular diameter capable of receiving the lower end portion of the post 12. Extending radially from the central sleeve 32 is a series of radial arms. In the design shown herein, each radial arm includes a bent or curved segment of metal stock. More particularly, each radial arm includes a base runner 34*a* and an upwardly projecting diagonal run 34*b*. The runs 34*a* and 34*b* form a single piece of curved stock. Secured to the lower outer portion of the respective base runners 34*a* is a toe 34*c* that engages the underlying ground or any other underlying support structure.

In use, the post 12 is placed within a concrete footing or is installed within the base 30. Once supported within such a footing or the base 30, the post 12 extends upright. Thereafter, the individual supports 28 are extended downwardly through the respective openings 18 and 26 formed in the annular bands 18 and 24 respectively. As pointed out above, the openings 18 and 26 are vertically aligned such that aligned openings will surround and confine the supports 28. To install a particular support 28, the lower end is first inserted through an opening 26 in the upper annular band 24. Then the support is simply lowered downwardly such that the lower terminal end of the support is extended downwardly through an aligned opening 18 formed in the intermediate guide or lower annular band 16. As seen in FIG. 1, the respective supports 28 can be lowered downwardly until the lower terminal ends engage the stop 14.

In the embodiment illustrated herein, the annular bands 16 and 24 include six separate openings. However, it is appreciated that the number of openings formed in the respective annular bands can vary.

As illustrated in FIG. 1, the supports 28 can be vertically adjusted and stationed along the post 12. In order to move the supports 28 up and down through respective openings 18 and 26, the individual set or thumb screws 22 are loosened such that elongated sections 28*a* can freely move through the openings. To station a support 28 at a certain elevation, the adjacent set or thumb screw 22 is screwed into engagement with the elongated section 28*a* of the support 28. This is illustrated in FIG. 4. By screwing the set screw 22 into engagement with the support, the support is pushed against the opposite side of the adjacent opening 18. This tends to bind or frictionally hold the entire support 28 about the set screw 22 and the adjacent opening 18. It is thus appreciated that all of the supports 28 that may be circumferentially spaced around the post can be easily and quickly vertically adjusted by simply releasing the fastener or set screw 22 and adjusting the support 28 up or down to reach a selected or desirable height and thereafter turning the fastener or set screw 22 to where it engages and causes the support 28 to be firmly held between the set screw or fastener and the adjacent opening 18 formed in the annular band 16.

The post 12 and the supports 28 can be chosen to be of various heights. In one embodiment, it is contemplated that the post 12 and the respective supports 28 would be of a height that would allow the supports 28 to be adjusted from a height of approximately 5 feet (see the rightmost support 28 in FIG. 1) to a height of approximately 7 feet 6 inches (see the leftmost support 28 in FIG. 1). Clearly, the remaining supports 28 that may occupy other openings 18 and 26 can be stationed at various heights between the heights illustrated in FIG. 1.

From the foregoing specification and discussion, it is seen that the present invention entails a support structure 10 that is particularly designed to support hanging plant baskets or other objects and that the same can be stationed at many different locations including areas of one's yard or garden as well as inside homes and buildings. The support structure 10 is relatively simple and easy to manufacture while at the same time providing a design that includes a series of supports that are vertically adjustable about a central post.

The present invention may, of course, be carried out in other specific ways than those herein set forth without parting from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A post-type support structure for supporting hanging baskets and other objects, comprising:

a) an elongated central post having upper and lower end portions and adapted to be supported in an upright position;

b) an intermediate guide secured to the post generally between the upper and lower end portions;

c) the intermediate guide having an annular band that extends around the post and which includes a series of circumferentially spaced openings formed therein;

d) an upper guide secured to the post above the intermediate guide and which includes an annular band extending around the post having a series of circumferentially spaced openings formed within the annular band;

e) an annular stop secured to the post below the intermediate guide;

f) a series of vertically adjustable supports adapted to extend through the openings of the intermediate and upper guides, each of the supports including an elongated section that extends adjacent the post and through the openings of the intermediate and upper guides, and an upper section that extends outwardly from the elongated section for supporting an object such as a hanging basket; and g) a fastener associated with respective openings of the intermediate guide for engaging the elongated section of a respective support passing through a particular opening within the intermediate guide for releasably stationing a respective support at a selected vertical position.

2. The support structure of claim 1 wherein the vertically adjustable supports assume a generally hook shaped configuration.

3. The support structure of claim 1 wherein the fasteners associated with the intermediate guide includes a series of set screws secured adjacent respective openings of the intermediate guide with each set screw operative to be screwed into engagement with the elongated section of a vertical support so as to effectively hold the support within the adjacent opening.

4. The support structure of claim 1 wherein the annular bands of intermediate and upper guides lie in planes that extend generally transversely with respect to the elongated axis of the post.

5. The support structure of claim 1 wherein the intermediate guide further includes a ring band secured to the annular band and wherein the ring band includes a series of threaded openings for receiving respective set screws that engage and hold the vertically adjustable supports in a position adjacent the post.

6. The support structure of claim 1 including a base adapted to receive the lower end portion of the central post.

7. The support structure of claim 1 wherein the openings formed within the annular bands of the intermediate and upper guides are generally vertically aligned such that the respective vertically adjustable supports can extend through the aligned openings.

8. The support structure of claim 1 wherein the openings formed in the annular bands of the intermediate and upper guides are generally square in shape and wherein the cross-sectional area of the supports are likewise generally square in cross-sectional areas such that when the supports are inserted through the openings, the shape of the openings and the supports prevents the supports from rotating.

9. A support structure for supporting plants and other objects comprising: a central support post; and a series of supports secured to the post, each support including an elongated, vertical section that extends along and adjacent the post and an outwardly extending section that extends outwardly from the post for supporting an object; a holding structure secured on the post for supporting the individual supports about the post, the holding structure including a series of openings spaced around the post through which the supports pass; and wherein the holding structure includes first and second sets of openings with a first set of openings being disposed intermediately on the post and a second set of openings disposed above the first set of openings, and wherein the openings of the first and second sets are vertically aligned such that a support may extend through two aligned openings of the sets.

10. The support structure of claim 9 wherein the supports are vertically adjustable up and down on the post.

11. The support of claim 9 wherein the series of supports are circumferentially spaced around the post such that the elongated sections of the supports extend adjacent the post in generally parallel relationship with the axis of the post.

12. The support structure of claim 10 including a fastener associated with each support for adjustably securing each support in any one of a number of different vertical positions about the post.

13. The support structure of claim 9 including a series of screw-type fasteners associated with the holding structure, each screw-type fastener adapted to be screwed into engagement with a support passing through an opening of the holding structure so as to secure the support in a selected vertical position about the post.

14. The support structure of claim 9 wherein the first set of openings are circumferentially spaced and formed in an annular ring that extends around the post, and wherein there is provided a circumferential ring disposed adjacent the annular ring and wherein there is provided a series of set screws that extend through threaded openings formed in the circumferential ring, with each set screw being disposed adjacent a respective opening in the annular ring such that the screw can be screwed into engagement with a support passing through the adjacent opening.

15. The support structure of claim 9 wherein the openings are of a generally square shape and wherein the individual supports are of a like generally square cross-sectional area such that once inserted through the openings, the supports are prevented from rotating.

16. A post-type support structure for supporting a plurality of plant containers comprising:

a) an elongated post adapted to be supported in a vertical upright position;

b) a series of vertically adjustable supports supported around the post and movable up and down relative to the post;

c) each vertically adjustable support including an elongated section that extends along and adjacent the post and an outwardly projecting section that extends outwardly from the post for supporting a plant container;

d) a holding structure secured to the post for engaging and supporting the elongated sections of the supports in an upright and spaced pattern around the post;

e) wherein the holding structure includes a series of releasable fasteners with each releasable fastener being operative to engage and hold the elongated section of one support in a selected vertical position such that each support may be raised and lowered by releasing its respective fastener and raising or lowering the support and thereafter engaging the support with the fastener to station it at a selected elevation and f) the holding structure including a series of openings spaced around the post and wherein the supports are confined within the openings and are movable up and down therethrough, and wherein the holding structure includes two sets of openings, one set of openings disposed intermediately on the post and a second set of openings disposed about an upper end portion of the post and wherein the sets of openings are vertically aligned such that each support extends through one opening in each of the sets of openings.

17. The support structure of claim 16 wherein the releasable fasteners are supported by a fastener support disposed adjacent one set of openings and wherein the releasable fasteners include a series of set screws secured within the fastener support with each set screw adapted to engage a support extending through an adjacent opening so as to cause the support to be gripped by the set screw and the opening.

18. The support structure of claim 17 including a stop secured on the post below the holding structure, the stop including an annular plate that effectively prevents the supports from moving downwardly past the stop.

* * * * *